US008281780B2

(12) United States Patent
Carvalho et al.

(10) Patent No.: US 8,281,780 B2
(45) Date of Patent: Oct. 9, 2012

(54) REGULATION VALVE

(75) Inventors: Johnny Leonardo Carvalho, Taubate (BR); Kléber Luiz da Silva, Taubate (BR)

(73) Assignee: Coprecitec, S.L., Aretxabaleta (ES)

( * ) Notice: Subject to any disclaimer, the term of this patent is extended or adjusted under 35 U.S.C. 154(b) by 432 days.

(21) Appl. No.: 12/642,661

(22) Filed: Dec. 18, 2009

(65) Prior Publication Data

US 2010/0154777 A1 Jun. 24, 2010

(30) Foreign Application Priority Data

Dec. 19, 2008 (ES) ..... 200802600 U

(51) Int. Cl.
*F24C 3/00* (2006.01)

(52) U.S. Cl. ..... 126/39 E; 126/25 R; 126/39 N; 431/12; 431/18; 431/255; 431/344; 251/206; 251/207; 251/286; 29/401.1; 137/1; 137/599.16; 137/601.16

(58) Field of Classification Search ..... 126/39 E, 126/25 R, 39 N; 251/207, 286, 206; 29/401.1; 431/12, 18, 255, 344; 137/1, 599.16, 601.16
See application file for complete search history.

(56) References Cited

U.S. PATENT DOCUMENTS

| | | | |
|---|---|---|---|
| 791,260 | A | 5/1905 | Fuller |
| 1,215,653 | A | 2/1917 | Hale |
| 1,526,500 | A | 2/1925 | Kasch |
| 1,711,436 | A | 4/1929 | Williams |
| 1,869,764 | A | 8/1932 | Methudy |
| 1,921,762 | A | 8/1933 | Leins |
| 1,940,171 | A | 12/1933 | Huss |
| 2,101,356 | A | 12/1937 | Zak |
| 2,650,612 | A | 9/1953 | Brumbaugh |
| 2,650,613 | A | 9/1953 | Brumbaugh |
| 2,723,102 | A | 11/1955 | Mueller |
| 2,987,078 | A | 6/1961 | Du Perow |

(Continued)

FOREIGN PATENT DOCUMENTS

CN 201121736 9/2008

(Continued)

OTHER PUBLICATIONS

PCT/EP2006/001143 International Search Report dated Aug. 1, 2008.

(Continued)

*Primary Examiner* — Steven B McAllister
*Assistant Examiner* — Avinash Savani
(74) *Attorney, Agent, or Firm* — Tim L. Kitchen; Peter B. Scull; Hamilton DeSanctis & Cha, LLP

(57) ABSTRACT

A regulation valve having a valve body with a gas inlet. Housed within the valve body is a rotary regulatory body having a first inlet orifice corresponding to a first minimum flow of a first type of gas and a second inlet orifice corresponding to a second minimum flow of a second type of gas. The first and second inlet orifices are angularly displaced so that when the regulatory body assumes a first angular position within the regulatory body the first inlet orifice faces the gas inlet and so that when the regulatory body assumes a second angular position within the regulatory body the second inlet orifice faces the gas inlet. The regulation valve includes first and second sets of cooperating features that are capable of limiting rotation of the regulatory body to the first and second angular positions, respectively.

10 Claims, 3 Drawing Sheets

U.S. PATENT DOCUMENTS

| | | | | |
|---|---|---|---|---|
| 3,001,547 | A | | 9/1961 | Brumbaugh |
| 3,068,902 | A | | 12/1962 | Brumbaugh |
| 3,093,155 | A | | 6/1963 | Dawes |
| 3,107,082 | A | | 10/1963 | Reynolds |
| 3,313,490 | A | | 4/1967 | Loveland |
| 3,448,923 | A | | 6/1969 | Saponara |
| 3,537,473 | A | | 11/1970 | DeZurik |
| 3,643,688 | A | | 2/1972 | Meinert |
| 3,949,966 | A | | 4/1976 | Fabish |
| 3,964,514 | A | | 6/1976 | Manoogian et al. |
| 4,020,870 | A | | 5/1977 | Carlson |
| 4,093,178 | A | | 6/1978 | Hughes et al. |
| 4,140,297 | A | | 2/1979 | Bussell |
| 4,355,659 | A | | 10/1982 | Kelchner |
| 4,366,947 | A | | 1/1983 | Voege |
| 4,499,630 | A | | 2/1985 | Harris |
| 4,637,429 | A | | 1/1987 | Dietiker et al. |
| 4,862,917 | A | | 9/1989 | Genbauffe |
| 4,947,891 | A | | 8/1990 | Genbauffe |
| 5,009,393 | A | | 4/1991 | Massey |
| 5,020,774 | A | | 6/1991 | Christianson |
| 5,082,023 | A | | 1/1992 | D'Alayer de Costemore d'Arc |
| 5,141,018 | A | | 8/1992 | Guterman |
| 5,238,398 | A | | 8/1993 | Harris |
| 5,259,589 | A | * | 11/1993 | Posner ..... 251/285 |
| 5,345,838 | A | | 9/1994 | Howie |
| 5,413,141 | A | | 5/1995 | Dietiker |
| 5,435,343 | A | | 7/1995 | Buezis |
| 5,522,429 | A | | 6/1996 | Bechte |
| 5,899,439 | A | | 5/1999 | Gottwald |
| 5,931,387 | A | | 8/1999 | Hurley et al. |
| 5,983,884 | A | | 11/1999 | Lee |
| 5,992,457 | A | | 11/1999 | Humpert |
| 6,027,335 | A | | 2/2000 | Griffioen |
| 6,162,048 | A | | 12/2000 | Griffioen |
| 6,170,507 | B1 | | 1/2001 | Dalton et al. |
| 6,341,760 | B1 | | 1/2002 | Rawlings |
| 6,347,784 | B1 | | 2/2002 | Philipps-Liebich et al. |
| 6,357,721 | B1 | | 3/2002 | Maurer |
| RE37,617 | E | | 4/2002 | Sherman |
| 6,394,081 | B1 | | 5/2002 | Aguirre-Esponda et al. |
| 6,520,481 | B2 | | 2/2003 | Harneit |
| 6,640,390 | B1 | | 11/2003 | Lai |
| 6,666,227 | B2 | | 12/2003 | Erickson |
| 6,758,242 | B2 | | 7/2004 | Jones |
| 6,871,803 | B1 | | 3/2005 | Ohmi |
| 6,941,962 | B2 | | 9/2005 | Haddad |
| 7,096,887 | B2 | | 8/2006 | Tupa |
| 7,156,370 | B2 | | 1/2007 | Albizuri |
| 7,237,570 | B2 | | 7/2007 | Gamard |
| 7,458,386 | B2 | | 12/2008 | Zhang |
| 7,611,796 | B2 | | 11/2009 | Laresgoiti et al. |
| 7,641,470 | B2 | | 1/2010 | Albizuri |
| 7,651,330 | B2 | | 1/2010 | Albizuri |
| 7,950,384 | B2 | | 5/2011 | Albizuri |
| 7,963,763 | B2 | | 6/2011 | Albizuri |
| 2002/0048699 | A1 | | 4/2002 | Steele et al. |
| 2003/0010952 | A1 | | 1/2003 | Morete |
| 2004/0089830 | A1 | | 5/2004 | Beyrak |
| 2005/0109967 | A1 | | 5/2005 | Ohmi et al. |
| 2005/0202361 | A1 | | 9/2005 | Albizuri |
| 2006/0060251 | A1 | | 3/2006 | Gamard et al. |
| 2006/0197043 | A1 | * | 9/2006 | Santinanavat et al. ..... 251/92 |
| 2006/0201496 | A1 | | 9/2006 | Shingler |
| 2008/0138749 | A1 | | 6/2008 | Albizuri |
| 2008/0156378 | A1 | | 7/2008 | Zhang |
| 2008/0202496 | A1 | | 8/2008 | Albizuri |
| 2008/0289615 | A1 | | 11/2008 | Parrish |
| 2009/0047610 | A1 | | 2/2009 | Teng |
| 2010/0089385 | A1 | | 4/2010 | Albizuri |
| 2010/0089386 | A1 | | 4/2010 | Albizuri |
| 2011/0005508 | A1 | | 1/2011 | Albizuri |

FOREIGN PATENT DOCUMENTS

| | | | |
|---|---|---|---|
| CN | 201121736 | Y | 9/2008 |
| DE | 3039378 | A1 | 5/1982 |
| EP | 546714 | A1 | 6/1993 |
| EP | 546714 | B1 | 6/1993 |
| EP | 0805310 | | 11/1997 |
| EP | 1263067 | A2 | 12/2002 |
| ES | 1069849 | | 5/2009 |
| FR | 1517003 | | 2/1968 |
| FR | 2642148 | | 7/1990 |
| GB | 1298809 | | 12/1972 |
| GB | 1329893 | | 9/1973 |
| JP | 07153469 | A | 6/1995 |
| WO | 2000022689 | A1 | 4/2000 |
| WO | 2005122300 | A2 | 12/2005 |
| WO | 2006082057 | A2 | 8/2006 |
| WO | WO/2006/084690 | A2 | 8/2006 |

OTHER PUBLICATIONS

PCT/EP2006/001143 International Preliminary Report on Patentability dated Aug. 14, 2007.

European Patent Office, Extended European Search Report, Dec. 5, 2006, Munich.

Balazs G. Bryan, et al, Ac Impedance Studies of Rare Earth Oxide Doped Ceria, Solid State Ionics, 1995, v. 76 pp. 155-162, Elsevier Science B.V.

Pratihar S.K, Solid Oxide Fuel Cells, Research Signpost 37/661(2); Applied Physics in the 21st Century, 2008, 73-108, pp. 9-10, archieved in http://dspace.nitrkl.ac.in/dspace.

Stefanik, Electrical Properties and Defect Structure of Praseodymium-Cerium Oxide Solid Solutions, Submitted to the Department of Materials Science and Engineering in Partial Fulfillment of the Requirements for the Degree of Doctor of Philosophy in Ceramics, Feb. 2004, © Massachusetts Institute of Technology, pp. 13-21.

* cited by examiner

REGULATION VALVE

CROSS-REFERENCE TO RELATED APPLICATIONS

This application claims priority to and the benefit of Spanish Utility Model Application No. U200802600, filed Dec. 19, 2008.

TECHNICAL FIELD

The present invention relates to gas valves adapted for use with different types of fuels.

BACKGROUND

Gas valves are known for domestic cooking appliances using a single valve for regulating the flow of two different types of gas such as natural gas (NG) and liquefied petroleum gas (LPG).

Spanish Utility Model Application Publication No. ES1059642U describes a gas valve for a gas burning appliance, such as a domestic cooking appliance, having a regulatory body coupled to a drive shaft. In one embodiment, a rotary control knob attached to the drive shaft establishes an angular limit position that determines a minimum flow of a gas passing through the valve which is dependent on the type of gas (e.g., natural gas (NG) or liquid petroleum gas (LPG)) being delivered through the tap.

SUMMARY OF THE DISCLOSURE

An object of the present invention is to provide a regulation valve for gas burning appliances, such as cooking appliances, that is adapted for regulating the flow of two different types of gas such as NG and LPG.

In accordance with one embodiment the regulation valve includes a valve body, a rotary regulatory body and a drive shaft attached to the regulatory body. The rotary regulatory body is housed in the valve body and has a plurality of inlet orifices that may be positioned to face a gas inlet by rotating the regulatory body by use of the drive shaft. A first inlet orifice corresponds to a first minimum flow of a first type of gas, and a second inlet orifice corresponds to a second minimum flow of a second type of gas. The first and second inlet orifices situated in the regulatory body at different angular positions.

The drive shaft and the valve body have cooperating features that limit the angular rotation of the regulatory body to a second angular position where the second inlet orifice is aligned to face the gas inlet. Attached to, or incorporated into the regulation valve, is a stop element which can be arranged in an active position or in a rest position. In the active position the stop element interacts with a feature of the drive shaft to limit the angular rotation of the regulatory body to a first angular position where the first inlet orifice is aligned to face the gas inlet, the first angular position preceding the second angular position. In the rest position, the stop element does not limit the angular rotation of the regulatory body to the first angular position, thereby permitting the regulatory body to be rotated by the drive shaft to the second angular position. In one implementation, the first angular position establishes a minimum flow rate of NG through the regulation valve and the second angular position establishes a minimum flow rate of LPG through the regulation valve.

Accordingly, by varying the position of the stop element, a single regulation valve may be used to regulate the flow of gas to a gas burning appliance regardless of the type of fuel used, thus avoiding a complicated adjustment of a minimum flow ($Q_{min}$).

BRIEF DESCRIPTION OF THE DRAWINGS

Alternative implementations of the present disclosure are disclosed herein with at least partial reference to the drawings wherein.

DETAILED DESCRIPTION

Figure 1:
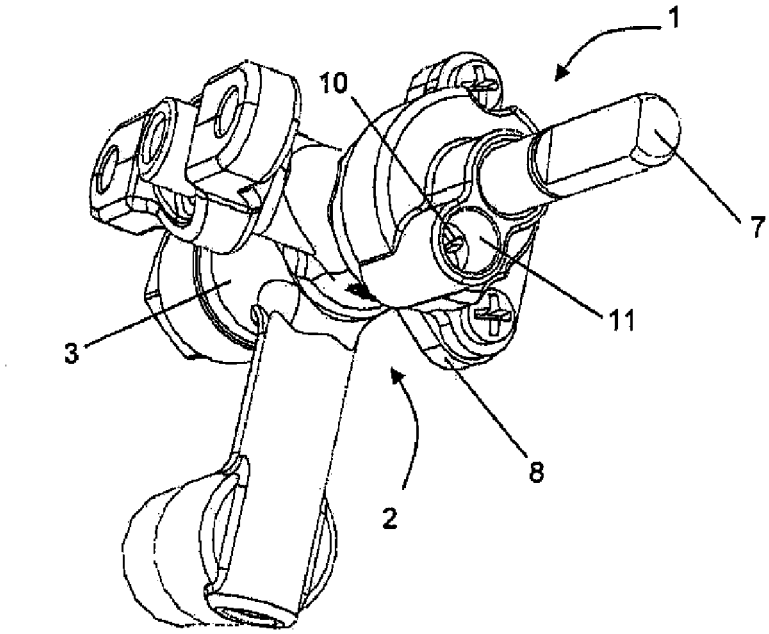
FIG. 1 is a perspective view of a regulation valve of one embodiment of the present invention.
Figure 2:
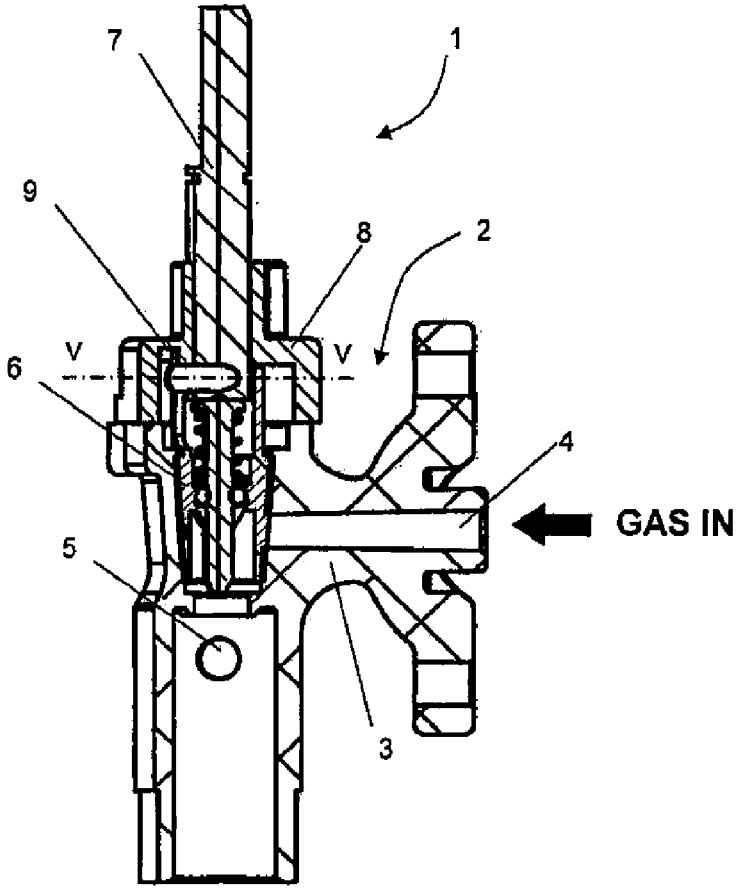
FIG. 2 is a cross-sectional view of the regulation valve of FIG. 1.

With reference to FIGS. 1 and 2, a regulation valve 1 for a gas burning appliance according to one embodiment of the present invention is illustrated. The regulation valve 1 includes a valve body 2, a rotary regulatory body 6, and a drive shaft 7 attached to the rotary regulatory body 6. In one implementation, the valve body 2 comprises a main body 3 and a cover 8. On the cover 8 is arranged a housing 11 in which is located a stop element 10. The regulatory body 6 is housed in the valve body 2 and has a plurality of inlet orifices that by turning the regulatory body 6, the inlets orifices are faced with a gas inlet 4 to provide a flow "Q" through an outlet 5 which is directed to a gas burner (not shown in the drawings). Among the plurality of inlet orifices there is a first radial inlet orifice for establishing a first minimum flow corresponding to a first type of gas, and a second radial inlet orifice for establishing a second minimum flow corresponding to a second type of gas. In one implementation, the first and second radial inlet orifices are arranged in adjacent first and second angular positions, respectively, with the first angular position preceding the second angular position.

In one embodiment, the drive shaft 7 has a radially extending projection 9 that cooperates with a feature (stopper) of the valve body 2 to limit the angular rotation of the regulatory body 6 to the second angular position where the second inlet orifice is aligned to face the gas inlet 4 to establish the second minimum flow.

Figure 3:
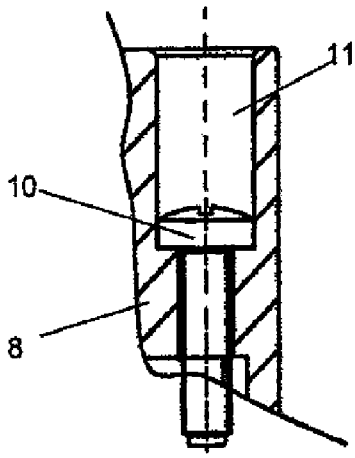
FIG. 3 illustrates a cross-sectional view of a stop element in one embodiment, the stop element being in an active position.
Figure 4:
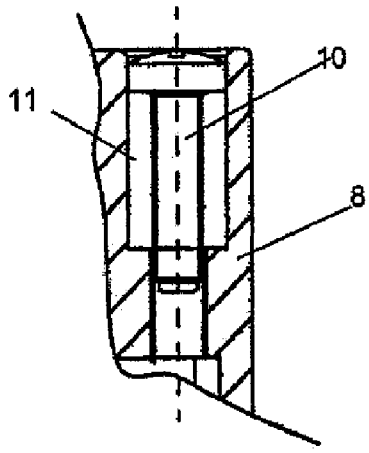
FIG. 4 illustrates a cross-sectional view of a cross section of the stop element of FIG. 3, the stop element being in a rest position.

In accordance with one embodiment, and as shown in FIGS. 1, 3, 4 and 5, the stop element 10 of the regulation valve 1 can be arranged in an active position (FIG. 3) or in a rest position (FIG. 4). In the active position the stop element 10 cooperates with the drive shaft projection 9 to limit the angular rotation of the regulatory body 6 to the first angular position where the first inlet orifice is aligned to face the gas inlet 4. In the rest position the stop element 10 does not engage with projection 9, thereby permitting the regulatory body 6 to be rotated to the second angular position. In one implementation, the first angular position establishes a minimum flow rate of NG through the regulation valve 1 and the second angular position establishes a minimum flow rate of LPG through the regulation valve 1. At the free end of the drive shaft 7 there may be assembled a control knob (not shown in the drawings) that may be unique to the type of gas delivered through the regulation valve.

In a preferred embodiment, the stop element 10 is a screw. To standardize the number of components and reduce the cost of the regulation valve 1, the screw is the same as other screws used in the assembly of the regulation valve 1.

As shown in FIGS. 3 and 4, in one embodiment the housing 11 comprises a threaded section and an elongated section, so that the screw does not protrude from the valve body 2 when it is arranged in the rest position. In such an embodiment, placement of the stop element/screw is achieved by threading the screw through the threaded section of the housing 11. Such an arrangement inhibits the valve from being easily inadvertently tampered with in a way that would result in an improper flow of the second type of gas to a burner of a gas appliance.

Figure 5:
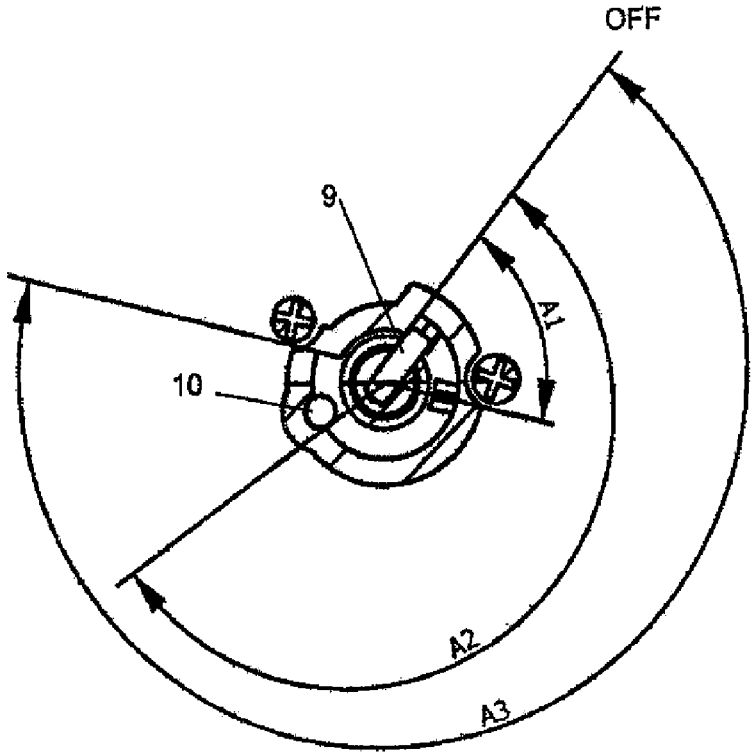
FIG. 5 is a detailed view of the cross section V-V of FIG. 2.

FIG. 5 shows an example of different operating rotation angles "A" of regulatory body 6. From an OFF angular position (the regulation valve 1 being closed) the regulatory body 6 is rotatable in a clockwise direction to regulate the flow of gas between a maximum flow ($Q_{max}$), intermediate flow ($Q_{int}$) and minimum flow ($Q_{min}$), depending on the rotated "A" angle. In selecting a minimum flow ($Q_{min}$) to be delivered to a burner of a gas burning appliance, the minimum flow for an NG type gas must be greater than the minimum flow for an LPG type gas for the burner to emit the same amount of heat in each instance.

In one embodiment, as shown in FIG. 5, the regulatory body 6 may rotate to a first angular position "A1" to supply a maximum flow ($Q_{max}$) for both a first type of gas (e.g., NG) and a second type of gas (e.g., LPG). Continued rotation of the regulatory body 6 produces an intermediate flow ($Q_{int}$) through the regulation valve 1. The flow $Q_{int}$, being less than $Q_{max}$. When the stop element 10 is in the active position, angular rotation of the regulatory body 6 is limited to the angular position "A2". In this position the first radial inlet orifice of a calibrated diameter or surface area faces the gas inlet 4 and establishes a minimum flow for the NG type of gas. On the other hand, if the stop element 10 is in the rest position, angular rotation of the regulatory body 6 is not limited to angular position "A2" but is permitted to rotate to angular position "A3". In this position the second radial inlet orifice of a calibrated diameter or surface area faces the gas inlet 4 and establishes a minimum flow for the second type of gas.

Figure 6:
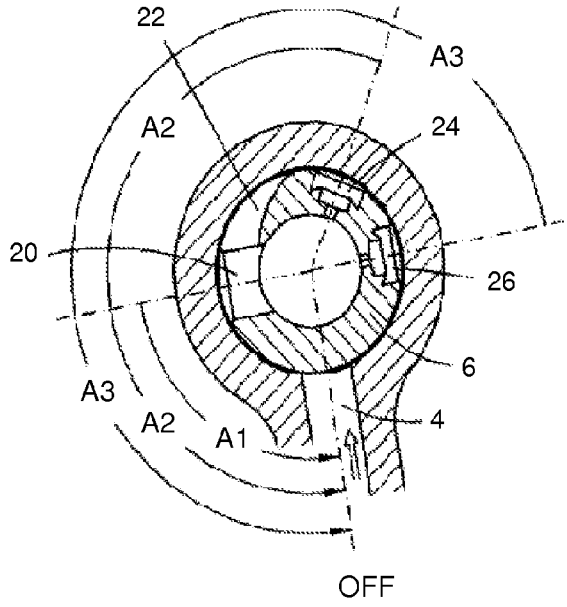
FIG. 6 illustrates a top cut-away view of the rotary regulatory body as situated in the valve body in accordance with one embodiment.

FIG. 6 illustrates a top cut-away view of the rotary regulatory body 6 as situated in the valve body 3 in accordance with one embodiment. For the purpose of simplifying the figure, elements 9 and 10 are not shown. As discussed above, the regulatory body 6 has an OFF angular position (the position depicted in FIG. 6) where gas flow from the gas inlet 4 is prevented from passing through the regulation valve 1. At the first angular position "Al" within the regulatory organ 6 is an inlet opening 20 adapted to supply through the regulation valve 1 the maximum flow (Qmax) for both the first type of gas (e.g., NG) and the second type of gas (e.g., LPG). At the second angular position "A2" within the regulatory organ 6 is positioned the first radial inlet orifice 24 which establishes the minimum flow for the first type of gas through the regulation valve 1. At the third angular position "A3" within the regulatory organ 6 is positioned the second radial inlet orifice 26 which establishes the minimum flow for the second type of gas through the regulation valve 1. A groove 22, or other means, may be situated between the inlet opening 20 and the first radial inlet orifice 24 to produce the intermediate flow (Qint) through the regulation valve 1.

By virtue of the operating features of the regulation valve of the various embodiments disclosed herein, a NG gas burning appliance or a LPG gas burning appliance can be operate with the same regulation valve 1, thus avoiding a complicated adjustment of the regulatory body 6 and reducing the need for skilled personnel.

What is claimed is:

1. A regulation valve for supplying either a first type of gas or a second type of gas to a gas burner, the regulation valve comprising:

a valve body having a gas inlet, a rotary regulatory body housed in said valve body, the regulatory body having a first inlet orifice corresponding to a first minimum flow of the first type of gas, and a second inlet orifice corresponding to a second minimum flow of the second type of gas, the rotary regulatory body rotates about a rotation axis between at least first, second and third successive angular positions, the first angular position corresponding to an off position, the first inlet orifice situated in the rotary regulatory body so that it is aligned to face the gas inlet when the rotary regulatory body is in the second angular position, the second inlet orifice situated in the rotary regulatory body so that it is aligned to face the gas inlet when the rotary regulatory body is in the third angular position, a drive shaft attached to the rotary regulatory body, a radially extending projection is coupled to the drive shaft and cooperates with another part of the regulation valve to limit the angular rotation of the rotary regulatory body to the third angular position where the second inlet orifice is aligned to face the gas inlet, and an elongate stop element having a proximal end section and a distal end section, the elongate stop element situated in a housing arranged on the valve body, the housing having an elongate passage with a proximal end and a distal end, the elongate stop element and the elongate passage each having a central axis that is substantially parallel to the rotation axis of the rotary regulatory body, the elongate stop element moveable within the elongate passage between a first axial position and a second axial position, in the first axial position the distal end section of the elongate stop element extends beyond the distal end of the elongate passage to interact with the radially extending projection that is coupled to the drive shaft to limit the angular rotation of the rotary regulatory body to the second angular position where the first inlet orifice is aligned to face the gas inlet, in the second axial position the distal end section of the elongate stop element does not extend beyond the distal end of the elongate passage to interact with the radially extending projection that is coupled to the drive shaft thereby permitting the rotary regulatory body to be rotated to the third angular position.

2. A regulation valve according to claim 1, wherein the first type of gas is natural gas and the second type of gas is liquid petroleum gas.

3. A regulation valve according to claim 1, wherein the distal end section of the elongate stop element comprises a threaded section, the elongate passage comprising an unthreaded proximal section and a threaded distal section, the elongate stop element being in the first axial position when the threaded section of the elongate stop element is threaded through the threaded distal section of the elongate passage.

4. A regulation valve according to claim 3, wherein the unthreaded proximal section of the elongate passage has a length sufficient to prevent the proximal end section of the elongate stop element from protruding from the housing when the elongate stop element is in the second axial position.

5. A regulation valve according to claim 1, wherein the valve body comprises a main body and a cover, the housing being a part of the cover.

6. A gas cooking appliance having a gas burner adapted for burning either a first type of gas or a second type of gas, the gas cooking appliance comprising at least one regulation valve for supplying either the first type of gas or the second type of gas to the gas burner, the regulation valve comprising a valve body having a gas inlet, a rotary regulatory body housed in said valve body, the rotary regulatory body having a first inlet orifice corresponding to a first minimum flow of the first type of gas, and a second inlet orifice corresponding to a second minimum flow of the second type of gas, the rotary regulatory body rotates about a rotation axis between at least first, second and third successive angular positions, the first angular position corresponding to an off position, the first inlet orifice situated in the rotary regulatory body so that it is aligned to face the gas inlet when the rotary regulatory body is in the second angular position, the second inlet orifice situated in the rotary regulatory body so that it is aligned to face the gas inlet when the rotary regulatory body is in the third angular position, a drive shaft attached to the rotary regulatory body, a radially extending projection is attached to the drive shaft and cooperates with another part of the regulation valve to limit the angular rotation of the rotary regulatory body to the third angular position where the second inlet orifice is aligned to face the gas inlet, and an elongate stop element having a proximal end section and a distal end section, the elongate stop element situated in a housing arranged on the valve body, the housing having an elongate passage with a proximal end and a distal end, the elongate stop element and the elongate passage each having a central axis that is substantially parallel to the rotation axis of the rotary regulatory body, the elongate stop element moveable within the elongate passage between a first axial position and a second axial position in the first axial position the distal end section of the elongate stop element extends beyond the distal end of the elongate passage to interact with the radially extending projection that is coupled to the drive shaft to limit the angular rotation of the rotary regulatory body to the second angular position where the first inlet orifice is aligned to face the gas inlet, in the second axial position the distal end section of the elongate stop element does not extend beyond the distal end of the elongate passage to interact with the radially extending projection that is coupled to the drive shaft thereby permitting the regulatory body to be rotated to the third angular position.

7. A gas cooking appliance according to claim 6, wherein the first type of gas is natural gas and the second type of gas is liquid petroleum gas.

8. A gas cooking appliance according to claim 6, wherein the distal end section of the elongate stop element comprises a threaded section, the elongate passage comprising an unthreaded proximal section and a threaded distal section, the elongate stop element being in the first axial position when the threaded section of the elongate stop element is threaded through the threaded distal section of the elongate passage.

9. A gas cooking appliance according to claim 8, wherein the unthreaded proximal section of the elongate passage has a length sufficient to prevent the proximal end section of the elongate stop element from protruding from the housing when the elongate stop element is in the second axial position.

10. A gas cooking appliance according to claim 6, wherein the valve body comprises a main body and a cover, the housing being a part of the cover.

* * * * *